US007874129B2

(12) United States Patent
Py et al.

(10) Patent No.: US 7,874,129 B2
(45) **Date of Patent: *Jan. 25, 2011**

(54) STERILE DE-MOLDING APPARATUS AND METHOD

(75) Inventors: Daniel Py, Larchmont, NY (US); Benoit Adamo, Pelham, NY (US); John Guthy, Southbury, CT (US); Nathaniel Houle, Hebron, CT (US); M. Jeffrey Willey, Brookfield, CT (US)

(73) Assignee: Medical Instill Technologies, Inc., New Milford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/371,601

(22) Filed: Feb. 14, 2009

(65) Prior Publication Data

US 2009/0145089 A1 Jun. 11, 2009

Related U.S. Application Data

(63) Continuation of application No. 11/374,522, filed on Mar. 13, 2006, now Pat. No. 7,490,453.

(60) Provisional application No. 60/660,935, filed on Mar. 11, 2005.

(51) Int. Cl.
*B65B 3/02* (2006.01)
*B65B 5/02* (2006.01)

(52) U.S. Cl. ..... 53/452; 53/425; 53/471; 53/561

(58) Field of Classification Search ..... 53/426, 53/425, 452, 471, 485, 561, 284.5, 287; 141/2, 141/82, 329
See application file for complete search history.

(56) References Cited

U.S. PATENT DOCUMENTS

| | | | | | |
|---|---|---|---|---|---|
| 3,911,640 | A | * | 10/1975 | Rausing | 53/426 |
| 4,208,852 | A | * | 6/1980 | Pioch | 53/167 |
| 4,543,770 | A | * | 10/1985 | Walter et al. | 53/511 |
| 5,067,532 | A | * | 11/1991 | Lang et al. | 141/329 |
| 5,129,212 | A | | 7/1992 | Duffey et al. | |
| 5,341,854 | A | | 8/1994 | Zezulka et al. | |
| 5,353,573 | A | | 10/1994 | Durrant | |

(Continued)

FOREIGN PATENT DOCUMENTS

| | | |
|---|---|---|
| WO | WO 02/40122 | 5/2002 |

(Continued)

*Primary Examiner*—Paul R Durand
(74) *Attorney, Agent, or Firm*—McCarter & English, LLP

(57) ABSTRACT

Apparatus for molding and filling a device having a body defining an opening in communication with an interior chamber for receiving a substance therein, and a closure including a penetrable and resealable portion for sealing the opening and substance received in the device. A mold includes within the aseptic chamber plural mold cavities shaped to form the closure and body, and substantially sterile surfaces extending about and contiguous to the peripheries of the mold cavities. An assembly device including end-of-arm tooling having an engaging portion engageable with each of the body and closure is movable relative to the mold to engage and de-mold the substantially sterile closures and bodies from the mold cavities. Flexible barriers are coupled to the mold and the tool to substantially prevent the passage of contaminants from the molding machine and tool therethrough.

20 Claims, 11 Drawing Sheets

U.S. PATENT DOCUMENTS

| | | | | |
|---|---|---|---|---|
| 5,641,004 | A | 6/1997 | Py | |
| 5,669,208 | A * | 9/1997 | Tabaroni et al. | 53/453 |
| 6,094,890 | A | 8/2000 | Michellon et al. | |
| 6,096,358 | A | 8/2000 | Murdick et al. | |
| 6,119,433 | A | 9/2000 | Kitahora et al. | |
| 6,134,866 | A | 10/2000 | Schoenewolff et al. | |
| 6,145,277 | A | 11/2000 | Lawecki et al. | |
| 6,164,044 | A * | 12/2000 | Porfano et al. | 53/471 |
| 6,189,292 | B1 | 2/2001 | Odell et al. | |
| 6,263,641 | B1 | 7/2001 | Odell et al. | |
| 6,326,010 | B1 | 12/2001 | Sano et al. | |
| 6,475,435 | B1 | 11/2002 | Taggart | |
| 6,536,188 | B1 | 3/2003 | Taggart | |
| 6,604,561 | B2 | 8/2003 | Py | |
| 6,622,457 | B2 | 9/2003 | Kurth | |
| 6,684,916 | B2 | 2/2004 | Py | |
| 6,779,318 | B2 * | 8/2004 | Wang | 53/410 |
| 6,929,040 | B2 | 8/2005 | Py | |
| 7,032,631 | B2 | 4/2006 | Py | |
| 7,096,896 | B2 | 8/2006 | Py | |
| 7,111,649 | B2 | 9/2006 | Py | |
| 7,270,158 | B2 | 9/2007 | Py | |
| 2002/0023409 | A1 | 2/2002 | Py | |
| 2003/0088216 | A1 | 5/2003 | Py | |
| 2003/0089743 | A1 | 5/2003 | Py et al. | |
| 2003/0159750 | A1 | 8/2003 | Py | |
| 2004/0256026 | A1 * | 12/2004 | Py | 141/329 |
| 2005/0223677 | A1 * | 10/2005 | Py | 53/140 |

FOREIGN PATENT DOCUMENTS

| | | |
|---|---|---|
| WO | WO 02/49821 | 6/2002 |
| WO | WO 03/022313 | 3/2003 |
| WO | WO 03/041763 | 5/2003 |
| WO | WO 04/000100 | 12/2003 |
| WO | WO 2004/004803 | 1/2004 |
| WO | WO 2004/014778 | 2/2004 |

* cited by examiner

STERILE DE-MOLDING APPARATUS AND METHOD

CROSS-REFERENCE TO PRIORITY APPLICATIONS

This application is a continuation of U.S. Patent Application Ser. No. 11/374,522, filed Mar. 13, 2006, now U.S. Pat. No. 7,490,453, which claims priority to U.S. Provisional Patent Application No. 60/660,935, filed Mar. 11, 2005, both of which are incorporated by reference in their entireties as part of the present disclosure.

FIELD OF THE INVENTION

The present invention relates to apparatus and methods for molding container assemblies having containers and stoppers for sealing openings in the containers, such as containers having polymeric stoppers that are needle penetrable for filling the closed container with a substance therethrough and that are laser resealable for laser resealing the needle penetrated region of the stopper, and more particularly, to apparatus and methods for molding, de-molding and assembling such containers and stoppers under aseptic conditions.

BACKGROUND OF THE INVENTION

A typical aseptically filled container assembly, such as container assemblies for storing and dispensing medicaments, for example, vaccines and pharmaceuticals, or foods and beverages, such as liquid nutrition products, includes a container or container body defining a storage chamber, a fill opening in fluid communication with the container or container body, and a stopper or cap for sealing the fill opening after filling the storage chamber to hermetically seal the medicament, food, beverage or other substance within the container. In order to fill such prior art containers with a sterile fluid or other substance, it is typically necessary to sterilize the unassembled components of the dispenser or container, such as by autoclaving the components and/or exposing the components to gamma radiation. The sterilized components then must be filled and assembled in an aseptic isolator of a sterile filling machine. In some cases, the sterilized components are contained within multiple sealed bags or other sterile enclosures for transportation to the sterile filling machine. In other cases, the sterilization equipment is located at the entry to the sterile filling machine. In a filling machine of this type, every component is transferred sterile into the isolator, the storage chamber of the container is filled with the fluid or other substance, the sterilized stopper is assembled to the container to plug the fill opening and hermetically seal the fluid or other substance in the container, and then a crimping ring or other locking member is assembled to the container to secure the stopper thereto.

One of the drawbacks associated with such prior art container assemblies, and the processes and equipment for filling such container assemblies, is that the filling process is time consuming, and the processes and equipment are expensive. Further, the relatively complex nature of the filling processes and equipment can lead to more defectively filled containers than otherwise desired. For example, typically there are at least as many sources of failure as there are components. In many cases, there are complex assembly machines for assembling the containers that are located within the aseptic area of the filling machine that must be maintained sterile. This type of machinery can be a significant source of unwanted particles. Further, such isolators are required to maintain sterile air within a barrier enclosure. In closed barrier systems, convection flow is inevitable and thus laminar flow, or substantially laminar flow, cannot be achieved. When operation of an isolator is stopped, a media fill test may have to be performed which can last for several, if not many days, and can lead to repeated interruptions and significant reductions in production output for the pharmaceutical, nutritional or other product manufacturer that is using the equipment. In order to address such production issues, government-imposed regulations are becoming increasingly sophisticated and are further increasing the cost of already-expensive isolators and like filling equipment. On the other hand, governmental price controls and marketplace competition for pharmaceuticals and vaccines, including, for example, preventative medicines, and other aseptically filled products, such as liquid nutrition products, discourage such major financial investments. Accordingly, there is a concern that fewer companies will be able to afford such increasing levels of investment in sterile filling machines, thus further reducing competition in the pharmaceutical, vaccine, and nutritional product marketplaces.

Some prior art sterile filling machines and processes employ gamma radiation to sterilize the container components prior to filling and/or to terminally sterilize the containers after filling in cases where the product is believed to be gamma-radiation stable. One of the drawbacks of gamma sterilization is that it can damage or otherwise negatively affect the parts to be sterilized, such as by discoloring parts formed of plastic and other gamma-sensitive materials. In addition, if used to terminally sterilize filled containers, gamma radiation can damage the product stored within the container. Accordingly, gamma sterilization has limited applicability, and further, is not always a desirable form of sterilization for many types of products with which it is used.

Other prior art filling machines and processes employ fluid disinfectants or sterilizing agents or sterilants to sterilize the surfaces of the containers that will come into contact with the substance to be stored therein, such as foods or beverages. One such commonly used sterilant is vaporized hydrogen peroxide. In some such prior art filling machines and processes, the containers and stoppers for initially sterilized with a fluid sterilant, such as vaporized hydrogen peroxide, and the open containers are then filled with the product to be contained therein, such as a food or beverage, and then the stoppers or caps are applied to the containers to seal the product within the container. One of the drawbacks of such prior art filling machines and processes is that the fluid sterilant, such as vaporized hydrogen peroxide, necessarily must contact and sterilize the interior surfaces of the containers. As a result, the interiors of the containers, and thus the products filled in the containers can contain vaporized hydrogen peroxide residue. This, in turn, can lead to peroxidation or the formation of free radicals that can alter or otherwise degrade the product formulation during its shelf life, or otherwise can degrade the taste or other qualities of the product in the container.

Accordingly, it is an object of the present invention to overcome one or more of the above described drawbacks and disadvantages of the prior art.

SUMMARY OF THE INVENTION

In accordance with a first aspect, the present invention is directed to an apparatus comprising at least one mold including within an aseptic chamber at least one first mold cavity shaped to form at least one of a device closure and device body, and at least one first substantially sterile surface extending about the at least one first mold cavity. At least one tool of the apparatus is located within an aseptic chamber and includes an engaging portion engageable with a device body and/or a device closure located within the at least one first mold cavity. At least one of the first mold cavity and tool is movable relative to the other for engaging and de-molding a substantially sterile device closure and/or device body from the at least one first mold cavity. At least one source of sterile air of the apparatus is in fluid communication with the at least one aseptic chamber, and directs a flow of sterile air into the aseptic chamber and over the first sterile surface of the mold for maintaining the sterility of the mold surface and of the device closure and device body during de-molding thereof. A least one first flexible barrier is coupled to the mold between the at least one first sterile surface and a molding machine to substantially prevent the passage of contaminants from the molding machine therethrough. At least one second flexible barrier is coupled to the tool between the at least one engaging portion and a base portion of the tool to substantially prevent the passage of contaminants from the base portion of the tool therethrough.

In one embodiment of the present invention, the apparatus further comprises a filling and resealing station configured to receive a sealed, empty sterile device, and includes (i) at least one injection member that is movable between a first position for penetrating a penetrable and resealable portion of the device closure and introducing a substance from the injection member therethrough and into the interior chamber of the device body, and a second position spaced away from the penetrable and resealable portion of the device closure; and (ii) a thermal source for thermally sealing an injection member penetrated region of the penetrable and resealable portion of the device closure upon withdrawal of the injection member therefrom.

In one embodiment of the present invention, the mold includes within the aseptic chamber at least one first mold cavity shaped to form the device body, at least one second mold cavity shaped to form the device closure, at least one first substantially sterile surface extending about the first mold cavity, at least one second substantially sterile surface extending about the at least one second mold cavity, and two first flexible barriers. One of the first flexible barriers is coupled to the mold between the at least one first sterile surface and a respective molding machine to substantially prevent the passage of contaminants from the molding machine therethrough. The other first flexible barrier is coupled to the mold between the at least one second sterile surface and a respective molding machine to substantially prevent the passage of contaminants from the molding machine therethrough.

In one embodiment of the present invention, the mold includes a first mold portion and a second mold portion. The first mold portion defines a first sterile surface, the second mold portion defines a second sterile surface, and at least one of the first mold portion is movable relative to the second mold portion between a closed position for molding at least one of the device body and device closure, and an open position with the first and second sterile surfaces spaced relative to each other and defining a portion of the aseptic chamber therebetween. Preferably, the first sterile surface extends about a periphery of the first mold cavity, and the second sterile surface extends about a periphery of the second mold cavity. In one embodiment of the present invention, the apparatus further comprises at least one third substantially sterile surface extending about a periphery of the engaging portion of the tool.

In one embodiment, each of the first, second and third substantially sterile surfaces are defined by respective heated surfaces formed, for example, of a ceramic. In these embodiments, the apparatus preferably further comprises at least one heating source thermally coupled to each heated surface. The apparatus also preferably further comprises at least one temperature sensor operatively coupled to the at least one heating source and adapted to sense the temperature of the heated surface(s). The at least one heating source is responsive to the at least temperature sensor to control the temperature of the heated surface(s).

In one embodiment of the present invention, the apparatus further comprises at least one assembly device including the at least one tool, wherein the at least one assembly device and tool are configured to (i) de-mold a substantially sterile device closure from at least one first mold cavity, (ii) de-mold a substantially sterile device body from at least one first mold cavity, (iii) assemble within at least one aseptic chamber the substantially sterile device closure and device body into a sterile, sealed empty device, and (iv) transfer the sterile, sealed empty device to at least one of a transfer station and filling and resealing station for filling with a substance and resealing the filled device. In one embodiment of the invention, the tool includes at least one vacuum port in fluid communication with the engaging portion for drawing a vacuum through the port and, in turn, releasably securing at least one of a substantially sterile device closure and device body thereto.

In accordance with another aspect, the present invention is directed to an apparatus comprising first means for forming at least one enclosed aseptic chamber; second means located within at least one aseptic chamber and defining at least one mold cavity for forming at least one of a device closure and device body; and third means for forming at least one first substantially sterile region extending about the at least one first mold cavity. The apparatus further comprises fourth means located within at least one aseptic chamber and movable relative to the third means for engaging and de-molding at least one of a substantially sterile device closure and device body from the at least one first mold cavity; and fifth means coupled in fluid communication with the at least one aseptic chamber, for directing a flow of sterile air into the aseptic chamber and over the third means and fourth means for maintaining the sterility of the device closure and device body during de-molding thereof. The apparatus further comprises sixth means for preventing the passage of contaminants from a molding machine therethrough and into the at least one aseptic chamber; and a seventh means for preventing the passage of contaminants from a base portion of the fourth means therethrough and into the aseptic chamber.

In one embodiment of the invention, the apparatus further comprises eighth means for receiving a sealed, empty sterile device, penetrating a penetrable and resealable portion of the device closure and introducing a substance therethrough and into the interior chamber of the device, and resealing a penetrated region of the penetrable and resealable portion of the device closure.

In one embodiment, the first means is defined by at least one barrier enclosure; the second means is defined by at least one mold; the third means is defined by at least one sterile surface extending about a periphery of the least one mold cavity; the fourth means is defined by an end-of-arm tool including an engaging portion engageable with at least one of a device body and device closure; the fifth means is defined by at least one source of sterile air in fluid communication with the at least one aseptic chamber; the sixth means is defined by at least one flexible barrier; the seventh means is defined by at least one flexible barrier; and the eighth means is defined by a needle filling and thermal resealing station.

In accordance with another aspect, the present invention is directed to a method comprising the following steps:

(a) providing at least one barrier enclosure defining at least one aseptic chamber; at least one mold including within at least one aseptic chamber at least one first mold cavity shaped to form at least one of a device body and a device closure; and at least one tool including a tool engaging portion located within at least one aseptic chamber and movable relative to the at least one mold;

(b) molding in the at least one first mold cavity at least one of a device body and device closure;

(c) opening the mold to de-mold the molded device body and /or device closure;

(d) maintaining at least one first surface of the mold extending about the first mold cavity substantially sterile at least during opening of the mold to prevent any contaminants from contacting the molded device body and/or device closure during de-molding thereof, (e) directing a flow of sterile air into the at least one aseptic chamber, including into a space formed between opposing surfaces of the mold during opening thereof, and across the at least one first surface of the mold and any exposed surface of the device body and/or device closure;

(f) moving the tool engaging portion of the tool into the space formed between opposing surfaces of the mold, engaging with the tool engaging portion the molded device body and/or device closure and de-molding same with the tool engaging portion, and directing a flow of sterile air over at least the tool engaging portion and the molded device body and/or device closure during de-molding thereof, (g) providing at least one first flexible barrier coupled to the mold between the at least one first sterile surface and a molding machine and substantially preventing the passage of contaminants from the molding machine therethrough;

(h) providing at least one second flexible barrier coupled to the tool between the at least one engaging portion and a base portion of the tool and substantially preventing the passage of contaminants from the base portion of the tool therethrough; and (i) assembling at least one of a sterile device body and device closure to the other into a sealed, empty sterile device.

In one embodiment, the method further comprises penetrating a penetrable and resealable portion of the device closure, introducing a substance therethrough and into the interior chamber of the device, and resealing a penetrated region of the penetrable and resealable portion of the device closure.

In another embodiment, the method further comprises maintaining the at least one First surface of the mold extending about the first mold cavity substantially sterile by heating such surface(s) to a temperature sufficient to destroy substantially any germs thereon.

In yet another embodiment, the method further comprises the step of assembling with the tool within at least one aseptic chamber the substantially sterile device closure and device body into a sealed, empty sterile device, and transferring with the tool the device to at least one of a transfer station and a filling and resealing station.

One advantage of the present invention is that the device bodies and device closures are sterile at the time of formation due to the heat of the molten plastic used to form the parts, the introduction of the molten plastic into the mold cavity spaces thermally sterilizes the surfaces that contacts the plastic, or at least maintains such surfaces sterile, and thus the surfaces of the device parts are maintained sterile within the mold at the time of formation. Another advantage of the present invention is that when the mold is moved into the open position to allow de-molding of the sterile parts, the mold surfaces extending about the device parts (or mold cavities) are maintained sterile, and the space between the opposing surfaces of the open mold is maintained sterile by the flow of sterile gas therethrough. Yet another advantage is that the flexible barriers further substantially prevent any contaminants from entering the sterile space that otherwise might enter such space from the molding machine or base portion of the tool or related assembly device. A still further advantage is that when the tool engages and de-molds the device parts, the sterile gas flows over the tool and device parts to further maintain their sterility during de-molding. If desired, the tool can be used to assemble the device bodies and device closures within the aseptic enclosure into sealed, empty sterile devices. Then, the sealed, empty sterile devices can be aseptically filled, and laser resealed. Accordingly, the apparatus and method of the invention can obviate the need for an isolator, the need to use gamma radiation to sterilize the device parts, or the need to terminally sterilize the filled devices, thus avoiding the related problems encountered in the prior art.

Other advantages of the present invention will become more readily apparent in view of the following detailed description of the currently preferred embodiment and accompanying drawings.

BRIEF DESCRIPTION OF THE DRAWINGS

in FIG. 3B an exemplary installation of a flexible barrier on a mold half, in FIG. 3C the flexible barriers installed on the mold halves and on the assembly device; in FIG. 3D sterilization of the mold and end-of-arm tooling surfaces, such as by heating these surfaces; in FIG. 3E the mold in the closed position for molding the container parts; in FIG. 3F the mold in the open position and the end-of-arm tooling being moved into position to de-mold the molded container part; and in FIG. 3G the end-of-arm tooling engaging and de-molding the molded container part.

DETAILED DESCRIPTION OF A PREFERRED EMBODIMENT OF THE INVENTION

Figure 1A:
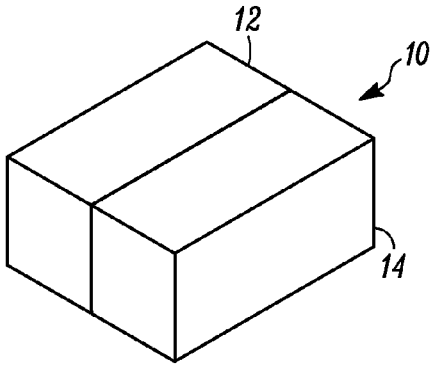
FIGS. 1A through 1F are somewhat schematic illustrations of the molds and assembly device of an apparatus embodying the present invention for molding needle penetrable and thermally resealable stoppers and container bodies, assembling the stoppers to the container bodies in or adjacent to the mold into sealed, empty sterile containers, needle penetrating the stoppers to aseptically fill the containers with product, and laser resealing the resulting needle holes in the stoppers to seal the product within the containers.
Figure 1B:
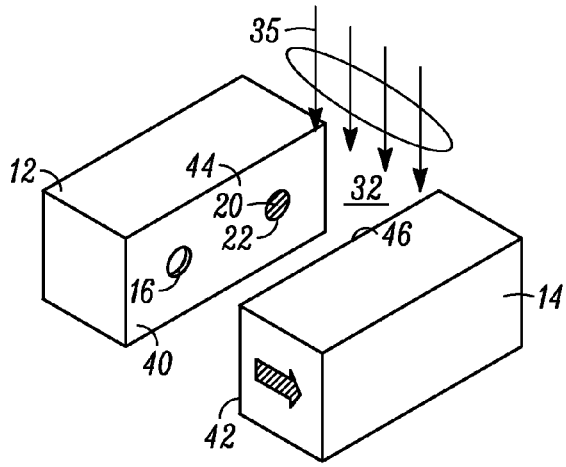
Figure 1C:
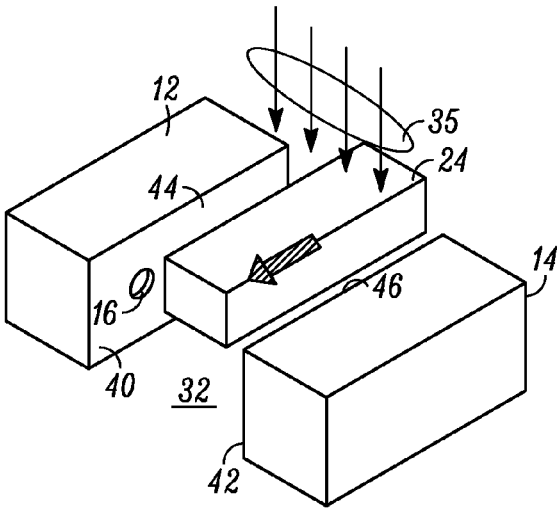
Figure 1D:
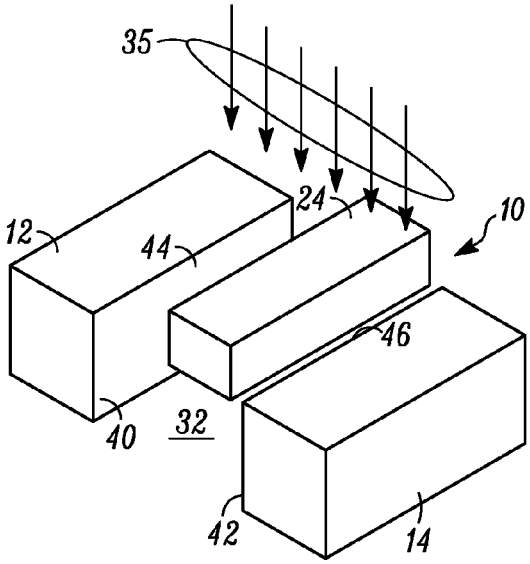
Figure 1E:
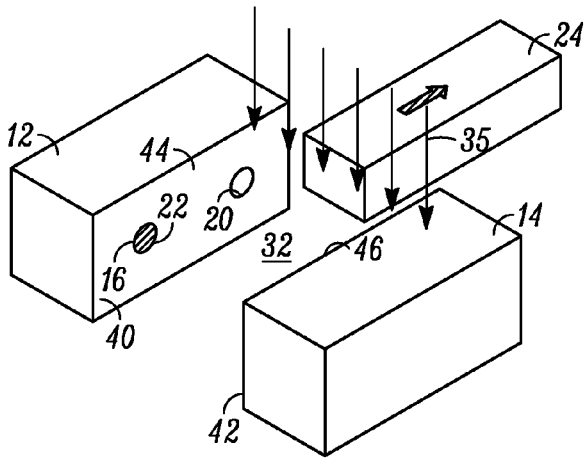
Figure 1F:
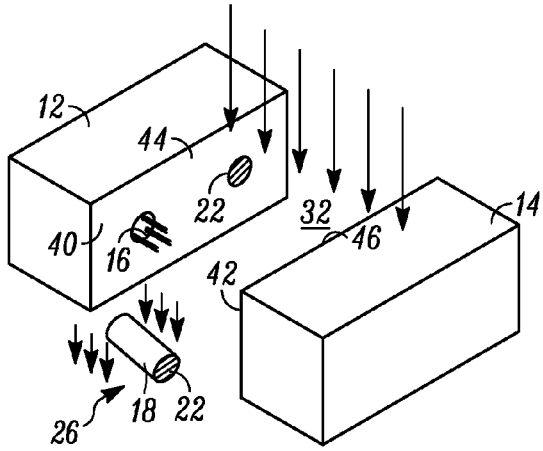

In FIGS. 1A through 1F, an apparatus embodying the present invention is indicated generally by the reference numeral 10. The apparatus 10 comprises a mold including a first mold half or portion 12, and a second mold half or portion 14. As can be seen, at least one of the first and second mold portions 12 and 14 is movable relative to the other in a manner known to those of ordinary skill in the pertinent art between a closed position for molding the container parts therein, and an open position for de-molding or releasing the molded container parts therefrom. The first and second mold portions 12 and 14 cooperate to define a first mold cavity 16 that is shaped to form the container body 18, and a second mold cavity 20 that is shaped to form the stopper 22. Although only one of each mold cavity is illustrated, the apparatus 10 may define a plurality of such mold cavities in a manner known to those of ordinary skill in the pertinent art in order to increase production throughput and/or to otherwise efficiently manufacture the container assemblies. As shown typically in FIGS. 3A-3G, the second mold portion 14 defines a plurality of core pins 17 that are received within the respective cavities 16, 20 of the first mold portion 12. When the mold portions 12, 14 are located in the closed position, the core pins 17 and mold cavities 16, 20 cooperate to define the mold cavity shapes for forming the parts, such as the container bodies or stoppers, therein. As may be recognized by those of ordinary skill in the pertinent art based on the teachings herein, each mold portion 12, 14 may define any number of mold cavities or core pins, or other mold structures, for forming any of numerous different parts in any of numerous different ways that are currently known or that later become known. In addition, each mold portion 12, 14 may comprise any desired number or configuration of components, including, for example, moving parts, such as any desired number or configuration of cavities, core pins and/or other hardware, as may be desired or otherwise required. Further, the apparatus may comprise any desired number of molds, including a set of molds for molding the container bodies, and a different set of molds to mold the stoppers, or other desired devices or container closures. Alternatively, the container bodies and stoppers may be molded in the same mold as shown. Unless otherwise indicated, the term "mold" is used herein to mean an apparatus or device defining one or more cavities in which one or more parts are shaped.

An assembly device 24 is located adjacent to the first and second mold portions 12 and 14, respectively, and is movable relative thereto for assembling the substantially sterile stopper 22 formed within the second mold cavity 20 and the container body 18 formed within the first mold cavity 16 into a sterile or aseptic, sealed container and stopper assembly or "container" 26.

Figure 2:
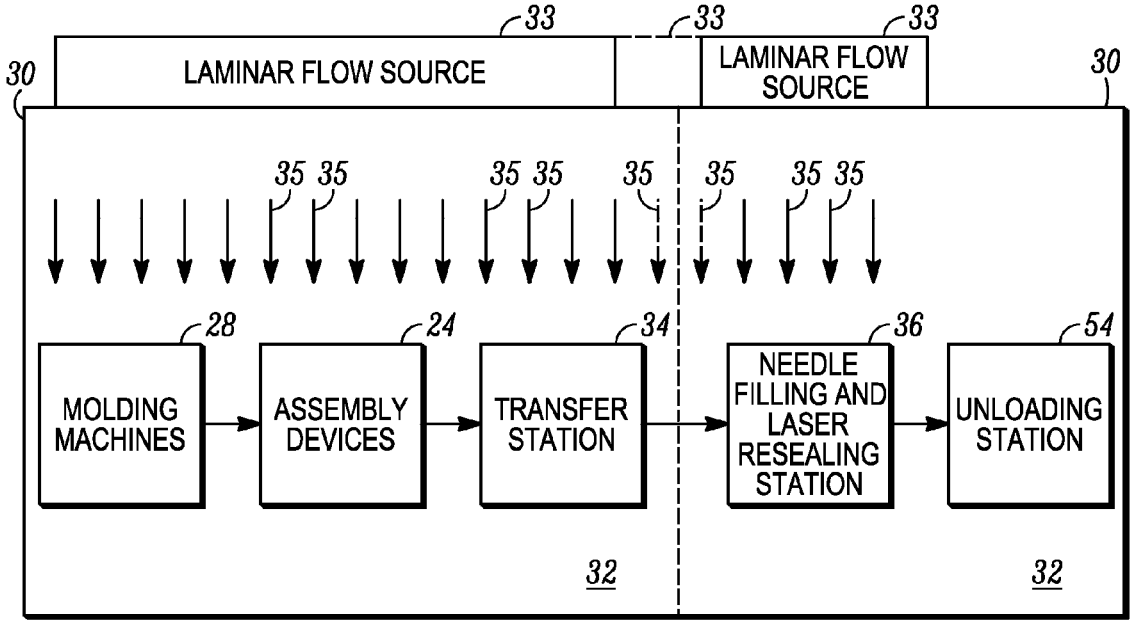
FIG. 2 is a schematic illustration of an apparatus embodying the present invention including the molds and assembly device of FIGS. 1A through 1F mounted within a barrier enclosure, a substantially laminar flow of sterile air or other gas introduced into the interior of the barrier enclosure, a container transfer station for receiving the sealed, empty sterile containers, a needle filling and laser resealing station for aseptically needle filling and laser resealing the containers with product, and a container unloading station for discharging the aseptically filled and sealed containers.

As shown in FIG. 2, the first and second mold portions 12 and 14, respectively, are mounted within one or more molding machines 28, such as plastic injection molding machines or other types of molding machines that are currently known, or that later become known for performing the function of the molding machines as disclosed herein. In the illustrated embodiment, the molding machine is a double barrel injection molding machine capable of delivering a first material or material blend to the first mold cavity or cavities 16 for forming the container bodies 18, and delivering a second material or material blend to the second mold cavity or cavities 20 for forming the stoppers 22.

As shown in FIG. 2, a barrier enclosure 30 of a type known to those of ordinary skill in the pertinent art surrounds or substantially surrounds the molding machine(s) 28 or the portions thereof containing the first and second mold portions 12 and 14, respectively, and defines an aseptic chamber 32. The relatively hot, sterile, stoppers and container bodies 22 and 18, respectively, are assembled within the aseptic chamber 32 prior to or upon discharge from the mold cavities 20 and 16, respectively, to form the sealed, sterile or aseptic containers 26.

As also shown in FIG. 2, one or more laminar flow sources 33 are coupled in fluid communication with the aseptic chamber 32 for directing a substantially laminar flow 35 of sterile air or other gas(es) into the aseptic chamber 32, over the mold surfaces adjacent to the cavities 16, 18, and over the stoppers 22 and container bodies 18 during assembly thereof, and upon removal from the mold portions 12, 14, to facilitate maintaining the sterility of the parts and otherwise to prevent any particles or other unwanted contaminants from entering the aseptic interior chambers of the containers 26. Each laminar flow source 33 may be mounted above the barrier enclosure 30 to direct the laminar flow 35 downwardly into the aseptic chamber 32. Alternatively, one or more laminar flow sources 33 may be mounted to a side of the barrier enclosure 30 to direct the laminar flow 35 laterally (or substantially horizontally) into and, in turn, through the aseptic chamber 32, or may be mounted in any of numerous other locations and/or positions to achieve the desired flow of sterile gas into and through the aseptic chamber. In one embodiment of the present invention, each laminar flow source 33 includes a filter and a fan to produce a filtered airflow into the aseptic chamber 32. This filtered airflow causes the air pressure within the barrier enclosure 30 to be somewhat greater than the air pressure outside the barrier enclosure. This pressure differential helps minimize the possibility of airflow into the barrier enclosure, which in turn helps prevent (or at least limit) the possibility that contaminants will get into the barrier enclosure 30. In some embodiments, the filter is a high efficiency filter, such as a HEPA filter.

A container transfer station 34 is mounted within the barrier enclosure 30 for collecting therein the sealed containers 26. The sealed containers 26 then may be packaged, such as in trays or boxes, which in turn may be packaged in one or more bags (such as double or triple bags) in a manner known to those of ordinary skill in the pertinent art. Alternatively, the sealed containers 26 may be fed directly from the transfer station 34 into a needle filling and thermal resealing station 36. The needle filling and thermal resealing station 36 may be located within the same barrier enclosure 30 (or aseptic chamber 32) as the mold portions 12, 14 and assembly device 24, or may be located within a separate barrier enclosure and aseptic chamber (not shown), and if desired, the separate barrier enclosure may be connected to the first aseptic chamber 32 in order to transfer the sealed containers 26 thereto.

The assembly device 24 is located adjacent to the first and second mold portions 12 and 14, respectively, and is movable relative thereto for assembling the molded substantially sterile stoppers 22 and containers 18 into sterile or aseptic, sealed containers 26. The assembly device 24 may take the form of a robot including, for example, a base that extends upwardly from a mounting flange, a first robotic arm that is pivotally driven on the base, and a second robotic arm that is pivotally driven on top of the first robotic arm. Both robotic arms are pivotally driven within the X and Y coordinate plane. The robot preferably further includes a z-drive that is drivingly mounted on the second robotic arm and drivable in the z-axis. In one embodiment, the robot is a "SCARA" robot sold by Epson Corporation under the model designation "E2S SCARA", such as one of the "E2S clean robots" that is clean room capable (class 10 clean room, for example). One such model is sold by Epson under the model number "E2S451C". However, as may be recognized by those of ordinary skill in the pertinent art based on the teachings herein, these robots are only exemplary, and the assembly device may take the form of any of numerous different robots or other assembly devices that are currently known or that later become known for performing the function of the assembly device 24 as described herein. In addition, the apparatus and/or method of the present invention may employ more than one robot or other assembly device to perform the functions performed by the assembly device 24 and/or to perform additional functions.

As shown in FIGS. 3A through 3G, the assembly device 24 includes an end-of-arm tool 38 for manipulating the container bodies 18, stoppers 22 and assembled containers 26. As can be seen, the tool 38 is movable by the assembly device 24 for assembling a substantially sterile stopper 22 from the first mold cavity and a substantially sterile container body 18 from the second mold cavity into a sealed, empty sterile container 26. The first and second mold portions 12, 14 include first aseptic or sterilized surfaces 40, 42 located adjacent to, and extending about the periphery of, the first mold cavity 16, that are sterilized to destroy substantially any germs or otherwise contaminants located thereon; the first and second mold portions 12, 14 also include second sterilized or aseptic surfaces 44, 46 (FIGS. 1A through 1F) located adjacent to, and extending about the periphery of, the second mold cavity 20 that are sterilized to destroy substantially any germs or other contaminants located thereon; and the assembly device 24 (FIGS. 3A-3G) includes a third sterilized or aseptic surface 48 located adjacent to, and extending about the periphery of, the end-of-arm tool 38 that is sterilized to destroy substantially any germs or other contaminants located thereon. In accordance with one embodiment of the present invention, each of the first, second and third sterilized or aseptic surfaces is thermally sterilized, and is defined by one or more heated surfaces, such as heated ceramic plates or other ceramic substrates of a type known to those of ordinary skill in the pertinent art. As may be recognized by those of ordinary skill in the pertinent art based on the teachings herein, such heated surfaces are only exemplary, and the sterilized or aseptic surfaces of the mold portions and/or assembly device may be sterilized in any of numerous different ways that are currently known, or that later become known. For example, one or more of these surfaces may be sterilized by the use of a fluid sterilant, such as vaporized hydrogen peroxide, as disclosed in commonly-assigned U.S. Provisional Patent Application Ser. No. 60/727,899, filed Oct. 17, 2005, entitled "Sterile De-Molding Apparatus And Method", which is hereby expressly incorporated by reference as part of the present disclosure. Alternatively, one or more of the sterile surfaces may be sterilized, and/or maintained sterile by the application thereto of radiation, such as UV radiation.

In the illustrated embodiment of the present invention, the apparatus 10 further comprises at least one heating source thermally coupled to the first, second and third sterile surfaces for heating each such surface to a temperature sufficient to destroy substantially any germs or other contaminants located thereon. In one embodiment of the present invention, the at least one heating source is an electric resistance heater. In this embodiment, the apparatus includes first electric resistance heaters 50 imbedded in, fixedly secured to, or otherwise thermally coupled to the first sterile surfaces 40, 42 (FIGS. 3A-3G), second electric resistance heaters (not shown) imbedded in, fixedly secured to, or otherwise thermally coupled to the second sterile surfaces 44, 46 (FIGS. 1A-1F), and a third electric resistance heater(s) (not shown) imbedded in, fixedly secured to, or otherwise thermally coupled to the third sterile surface(s) 48. As may be recognized by those of ordinary skill in the pertinent art based on the teachings herein, these heaters or heat sources are only exemplary, and numerous other types of heaters or heat sources that are currently known, or that later become known, equally may be employed.

The apparatus 10 further comprises a plurality of temperature sensors 52 operatively coupled to each heating source and adapted to sense the temperature of the respective sterile surface(s). Each heating source is responsive to signals transmitted by the respective temperature sensor 52 to control the temperature of the respective sterile surface(s). In the illustrated embodiment, each of the first, second and third sterile surfaces is heated to a temperature sufficient to sterilize the respective surface and thereby prevent contamination of at least the interior surfaces of the container bodies and stoppers. In one embodiment of the present invention, each of the first, second and third sterile surfaces is heated to a temperature of at least about 80° C., and more preferably, each of the first, second and third sterile surfaces is heated to a temperature within the range of about 80° C. through about 1800

Figure 3A:
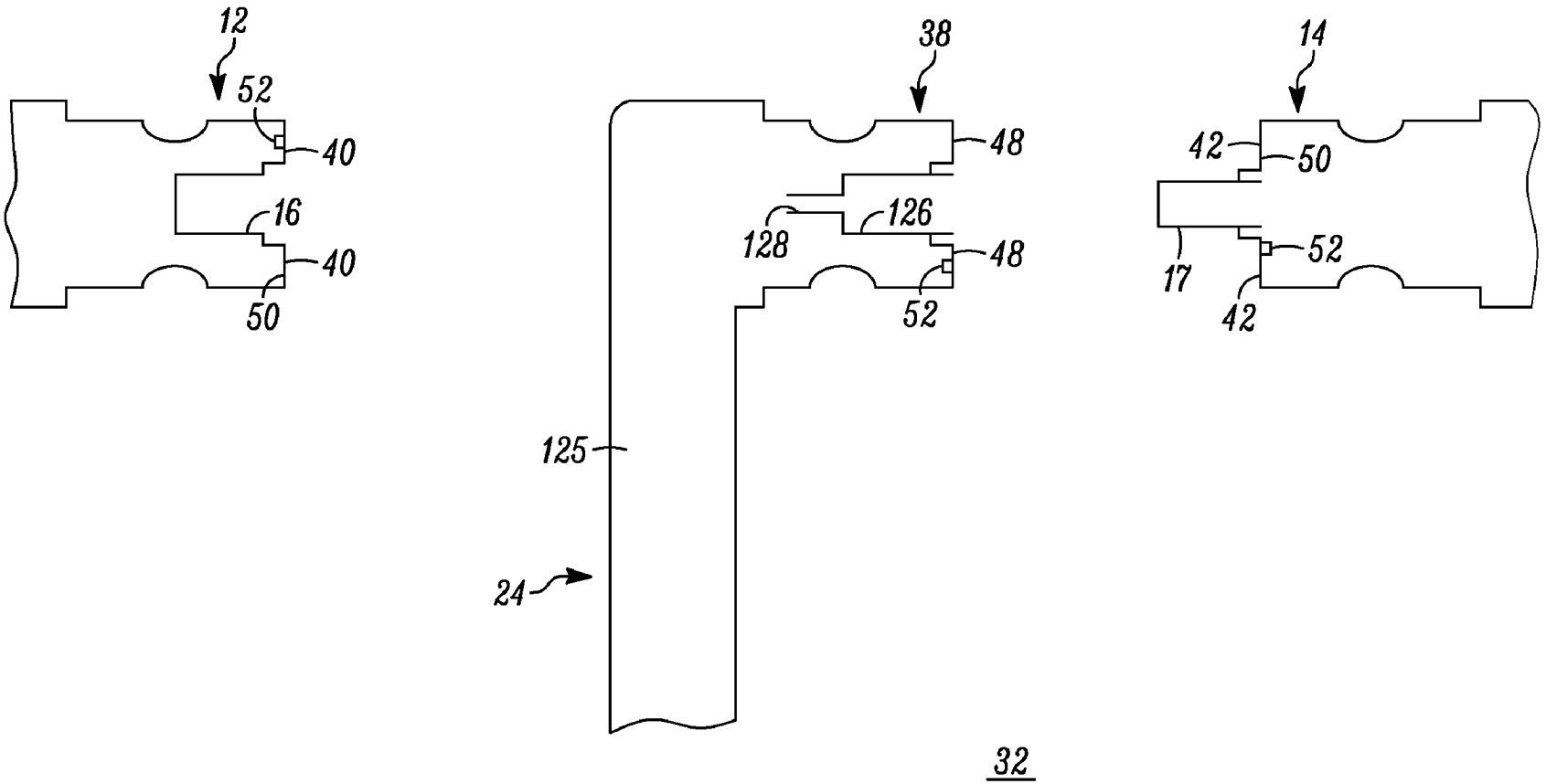
FIGS. 3A through 3G are schematic illustrations of the mold and robotic assembly device illustrating in FIG. 3A the mold halves and assembly device without flexible barriers.
Figure 3B:
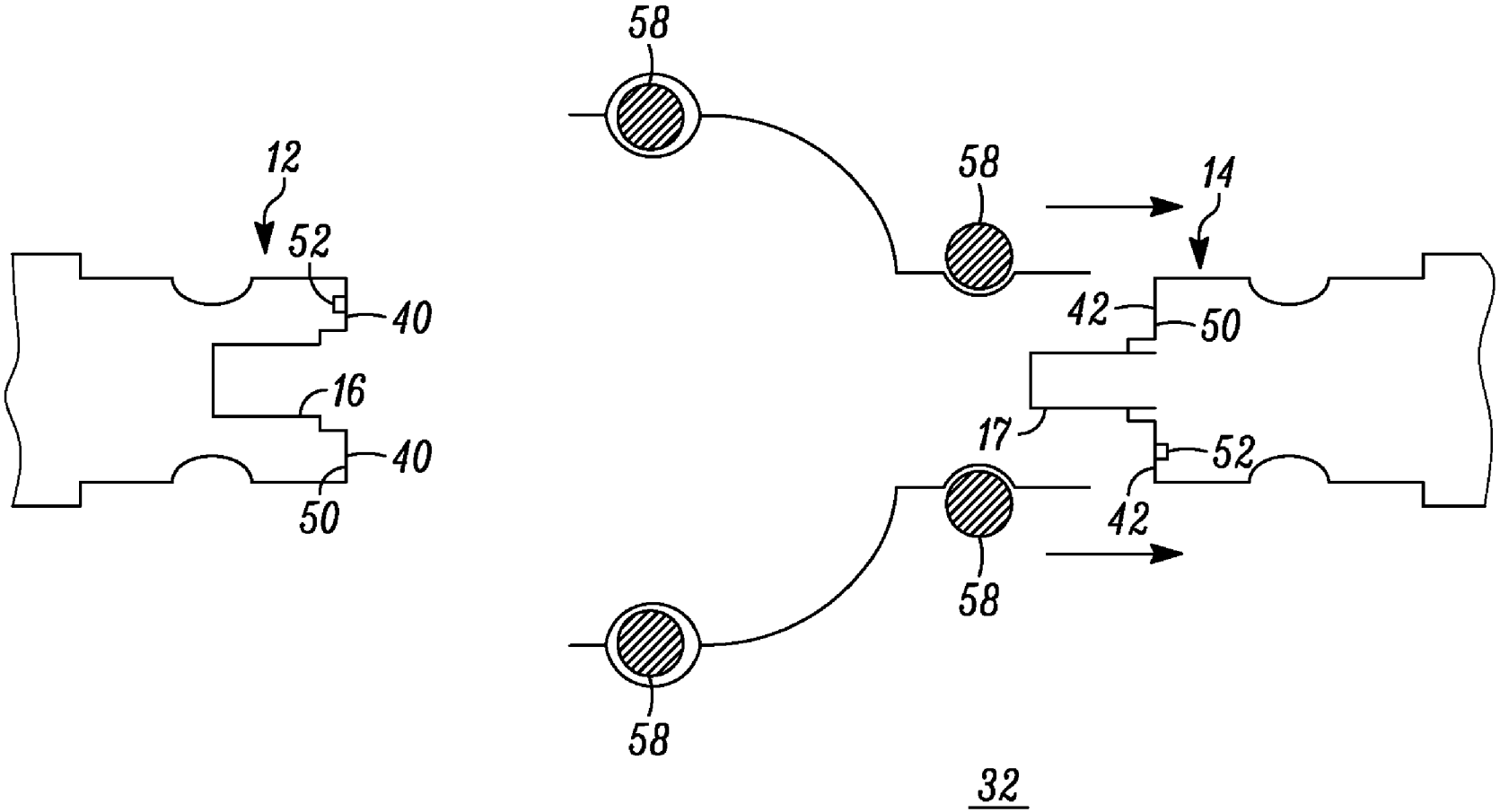
Figure 3C:
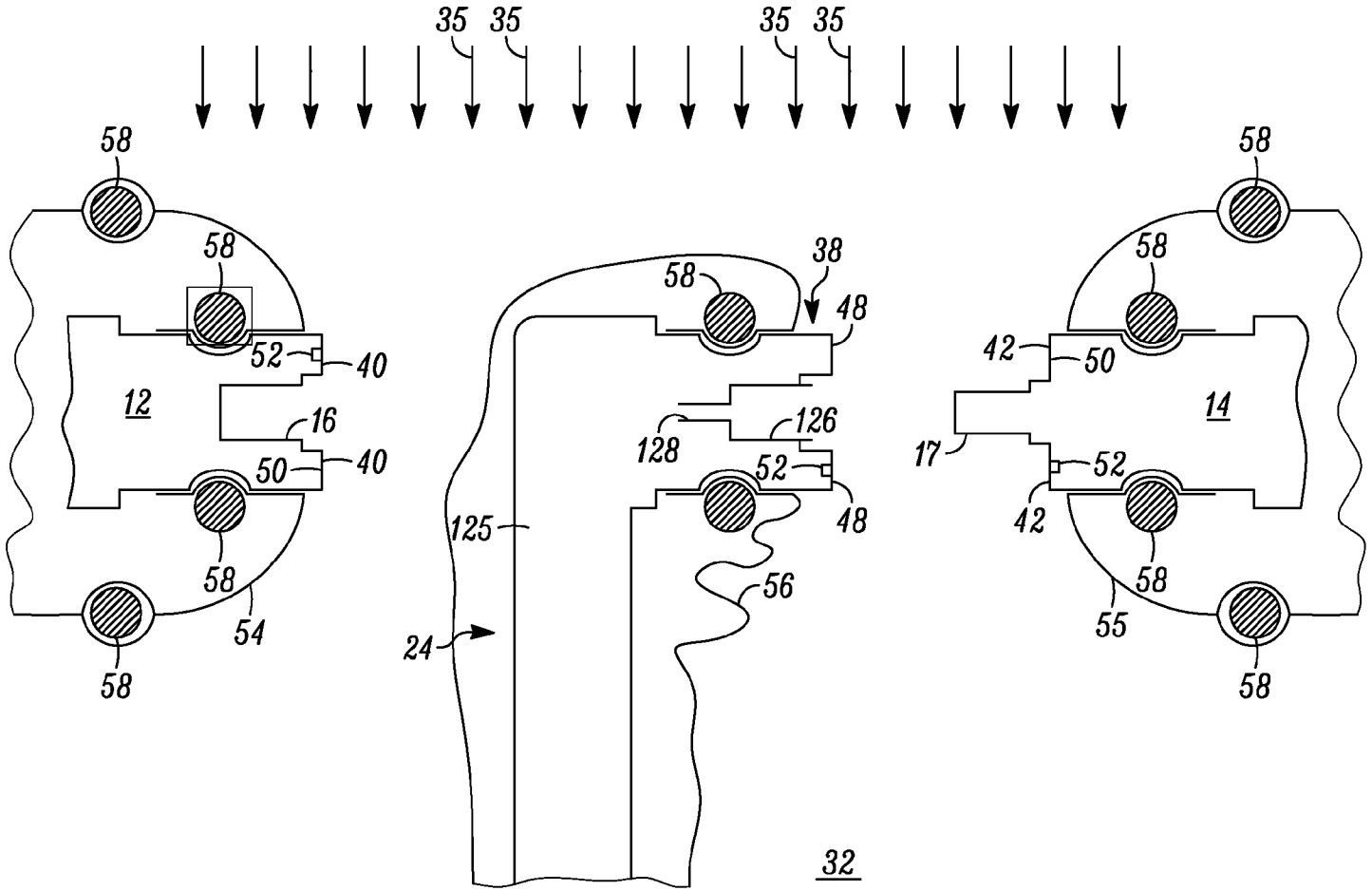
Figure 3D:
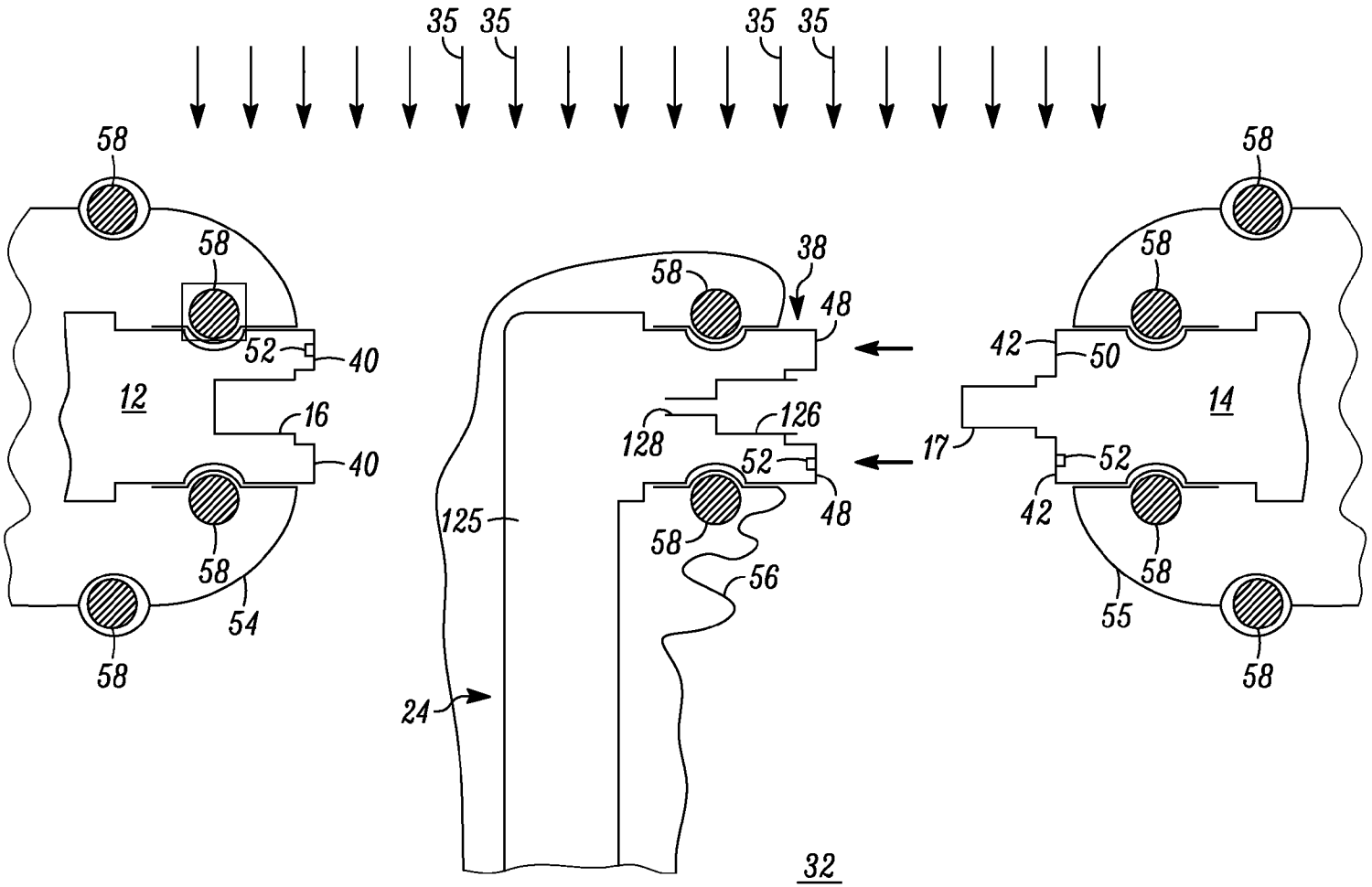
Figure 3E:
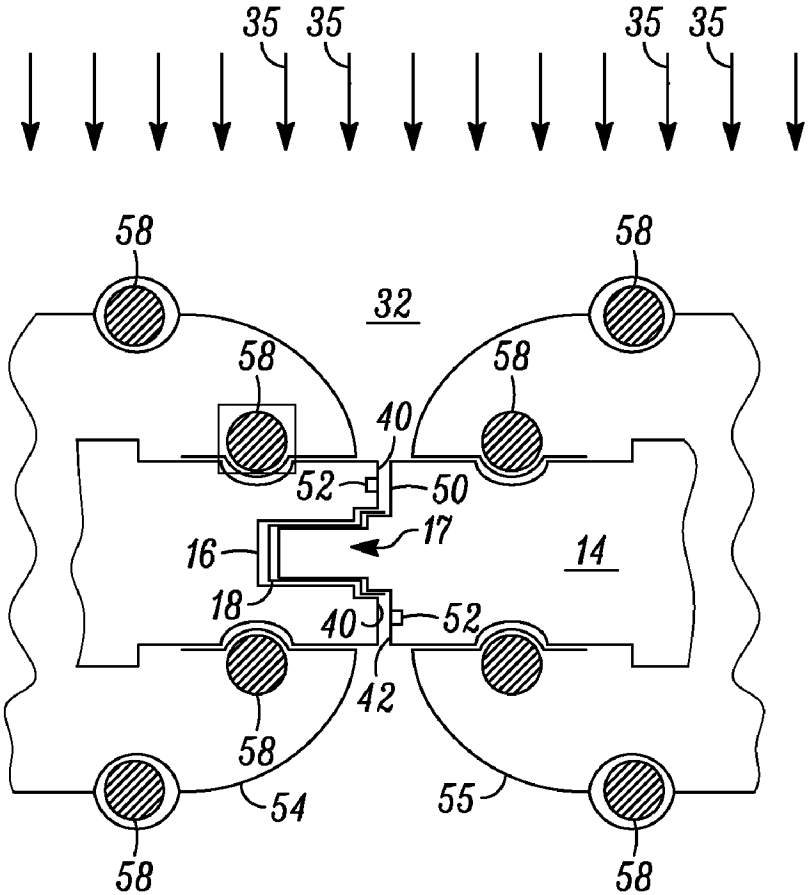
Figure 3F:
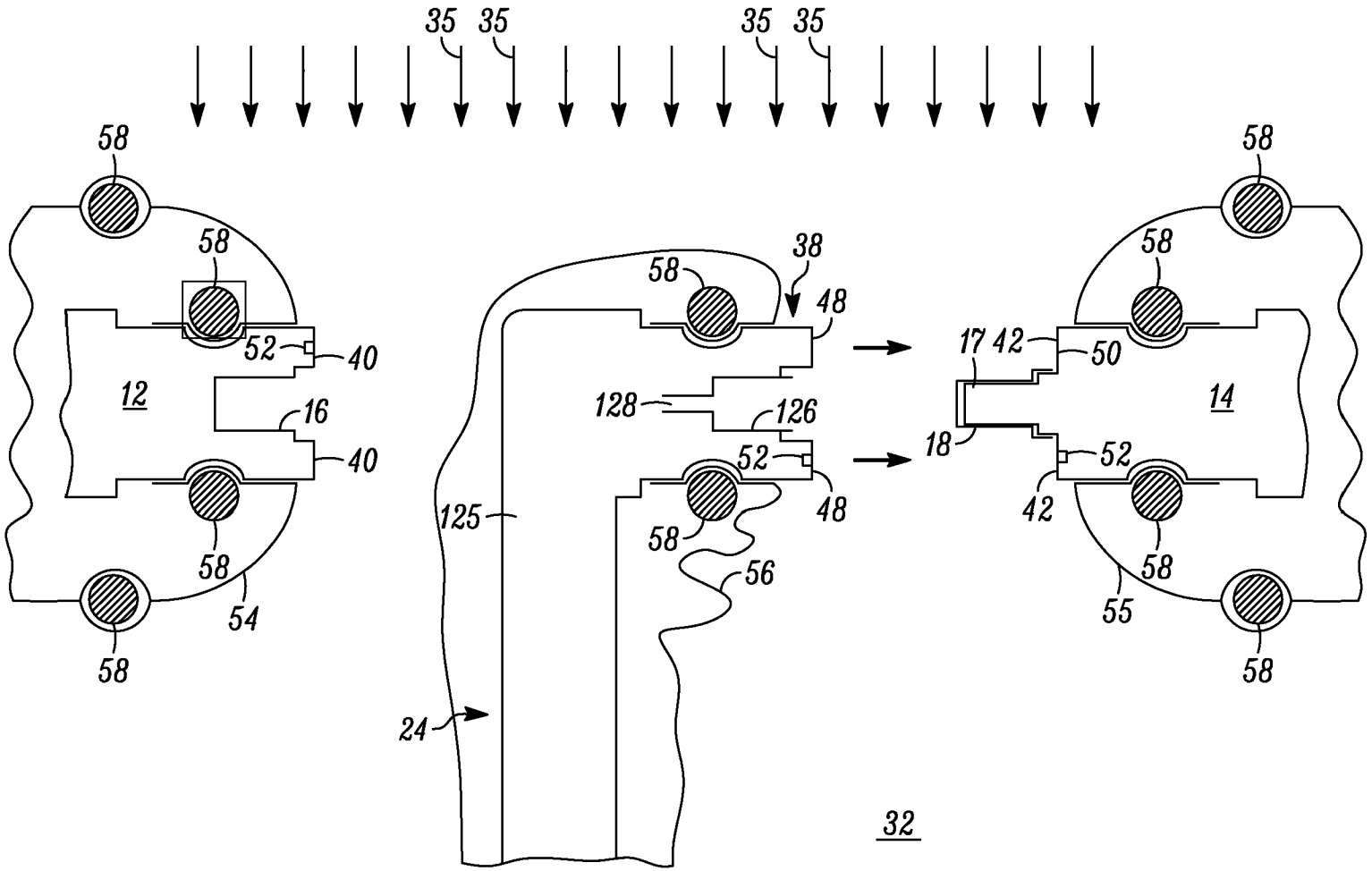

As shown in FIG. 3C, the apparatus 10 further comprises (i) a first flexible barrier 54 coupled to the first mold portion 12 between at least a portion of the first mold portion and the molding machine (not shown) that prevents the passage of particles or other contaminants therebetween; (ii) a second flexible barrier 55 (which may be the same as the first flexible barrier 54 or different) coupled to the second mold portion 14 between at least a portion of the second mold portion and the molding machine, and preventing the passage of particles or other contaminants therebetween; and (iii) a third flexible barrier 56 coupled to the assembly device 24 between the end-f-arm tool 38 and a base portion of the assembly device 24 and preventing the passage of particles or other contaminants therebetween. As can be seen, each flexible barrier 54, 55, 56 is sealed by a respective elastomeric sealing member 58, such as a gasket, o-ring, or other type of sealing member that secures the flexible barrier to the respective mold portion or assembly device, and forms a hermetic seal therebetween. Each flexible barrier may take the form of a polymeric bag or like polymeric sheet. However, as may be recognized by those of ordinary skill in the pertinent art based on the teachings herein, these flexible barriers and sealing members are only exemplary, and numerous other types of flexible barriers and sealing members or sealing mechanisms that are currently known, or that later become known, equally may be employed.

Figure 4A:
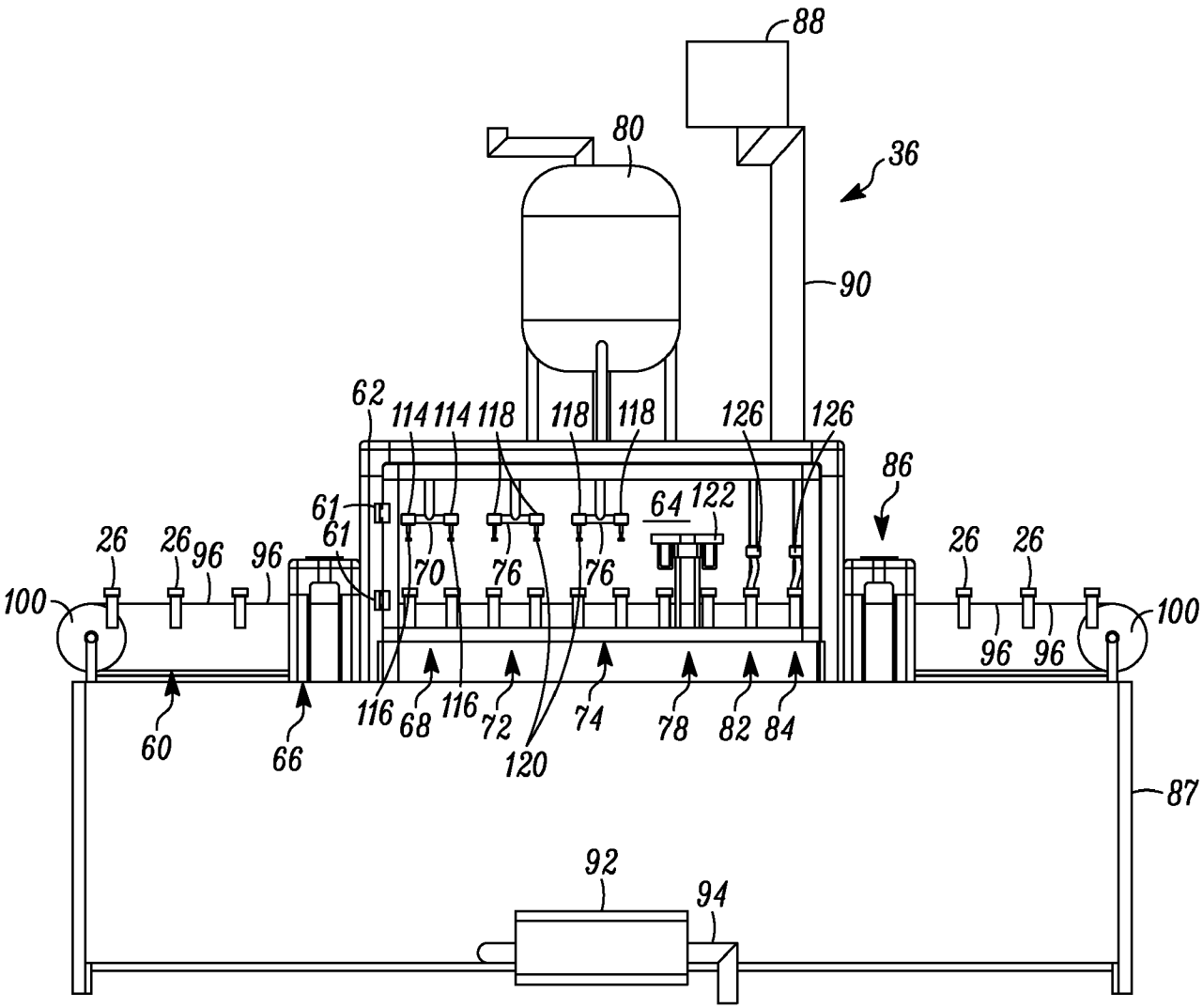
FIG. 4A is a side elevational view of the needle filling and laser resealing station of the apparatus FIG. 2.
Figure 4B:
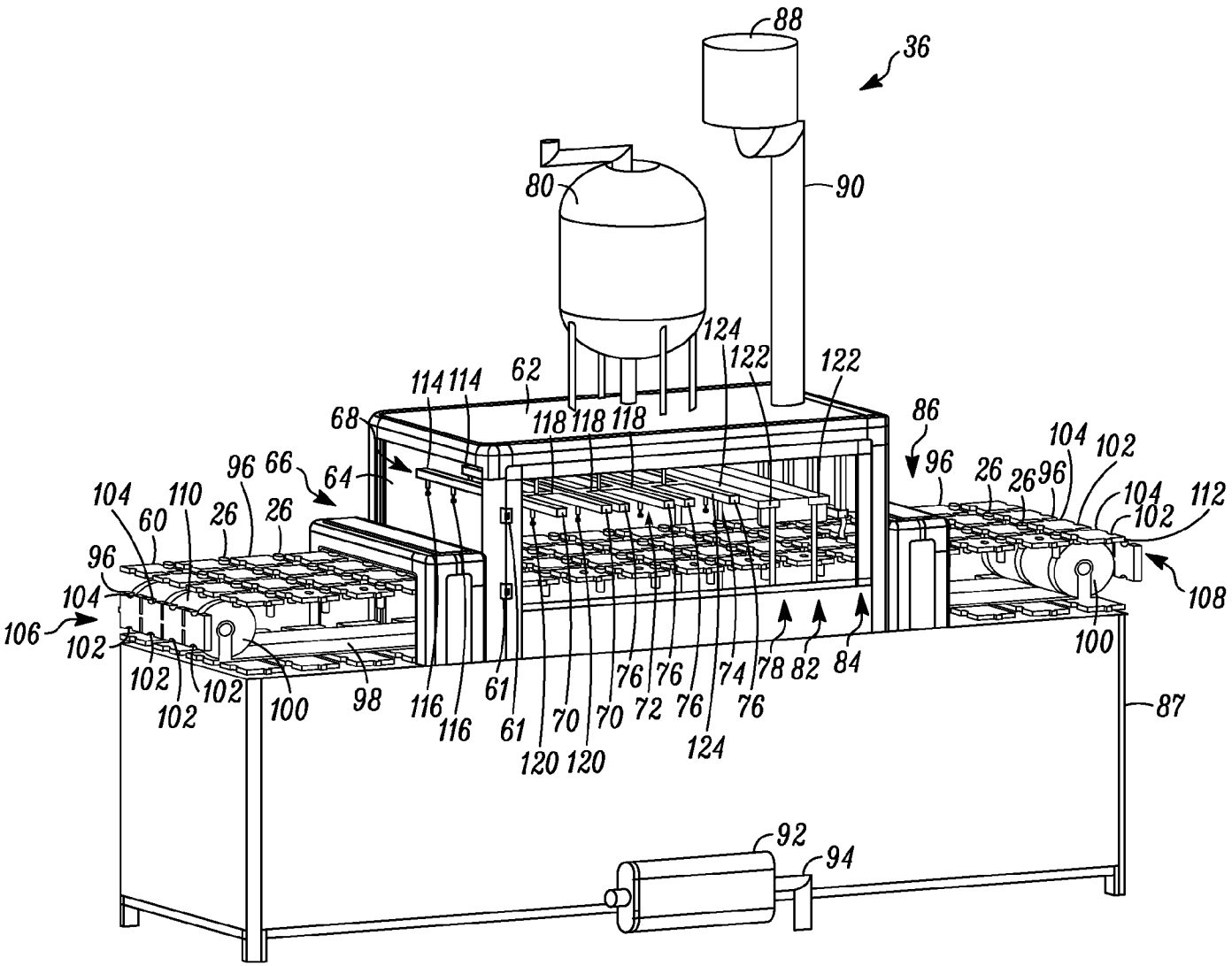
FIG. 4B is a perspective view of the needle filling and laser resealing station of FIG. 4A.

In FIGS. 4A and 4B, the exemplary needle filling and thermal resealing station 36 includes a closed loop or endless conveyor 60 for indexing and thereby conveying the containers 10 through the station. The containers 26 that are fed by the conveyor 60 into the station 36 include the stoppers 22 sealed to the openings of the container bodies 18. The interior chamber of each container 26 is sterile by assembling the stoppers 22 and container bodies 18 in the mold and/or within the sterile zone within or adjacent to the mold as described above. The station 36 includes an elongated housing 62 defining within it a sterile zone 64 and through which the conveyor 60 with the containers 26 located thereon passes. The term "sterile zone" is used herein within the meaning of the applicable regulatory guidelines as promulgated, for example, by the FDA (the United States Food and Drug Administration) or other national or applicable regulatory agency, and including any applicable Low Acid Canned Food ("LACF") regulations, and is preferably defined by a commercially sterile area that is maintained sterile by means of an over pressure of sterile air 35 (or laterally directed, or otherwise directed sterile air) as described above, or otherwise in a manner known to those of ordinary skill in the pertinent art. In the illustrated embodiment, the housing 62 includes side walls formed by see-through panels in order to allow an operator to view the interior of the needle filling and thermal resealing station. If desired, however, the side walls may be opaque, or may include an arrangement of opaque and see -through portions different than that shown. As shown, one or more of the side panels may be mounted to the housing frame by hinges 61 in order to pivot the respective side panel outwardly to access the interior of the housing to, for example, perform maintenance and/or repairs. Otherwise, the side and top walls of the housing 62 are sealed with respect to the ambient atmosphere to maintain the sterility of the sterile zone 64.

The needle filling and thermal resealing station 36 includes on its inlet end an inlet transfer station 66 through which the conveyor 60 passes for transferring the containers 26 mounted on the conveyor 60 into the sterile zone 64. A sterilizing station 68 is located within the housing 62 immediately downstream of the inlet transfer station 66 in the direction of conveyor movement (clockwise in FIGS. 4A and 4B) and includes one or more sterilizing heads 70 coupled to a source of fluid sterilant (not shown) such as a hydrogen peroxide, vaporized hydrogen peroxide sterilant ("VHP") or other fluid sterilant that is currently or later known, for transmitting the fluid sterilant onto the exterior surfaces of the containers 26 to sterilize the exterior surfaces. The station 36 further includes within the housing 62 a first sterilant removing station 72 located downstream of the sterilizing station 68 in the direction of conveyor movement, and a second sterilant removing station 74 located downstream of the first sterilant removing station 72. Each sterilant removing station 72, 74 includes one or more respective sterilant flushing heads 76 for transmitting heated sterile air or other gas over the exterior surfaces of the containers at a sufficient temperature, flow rate and/or volume, and for a sufficient time period to substantially entirely remove the fluid sterilant therefrom. The vaporized peroxide may condense at least in part on the surfaces of the containers and/or conveyor, and therefore it is desirable to flush such surfaces with a heated, sterile air or other gas to re-vaporize any condensed hydrogen peroxide and flush it out of the sterile zone. In the currently preferred embodiment, the temperature of the sterile air is at least about 60° C.; however, as may be recognized by those of ordinary skill in the pertinent art based on the teachings herein, the temperature may be set as desired or otherwise required by a particular application. A needle filling station 78 is located within the housing 62 downstream of the second sterilant removing station 74 for needle filling each container 26 with product from a product fill tank 80, and first and second laser resealing stations 82 and 84, respectively, are located downstream of the needle filling station 78 for laser resealing the resulting needle holes formed in the stoppers of the containers after filling the containers and withdrawing the needles. An exit transfer station 86 is located downstream of the laser resealing stations 82, 84 for transferring the filled containers 26 on the conveyor 60 out of the sterile zone 64. After exiting the sterile zone 64, the containers 26 may be capped with caps or other securing members that overly the stoppers and otherwise ready the filled containers for shipment.

The over pressure of sterile air or other gas is provided by a sterile gas source 88 including one or more suitable filters, such as HEPA filters, for sterilizing the air or other gas prior to introducing same into the sterile zone 64. A fluid conduit 90 is coupled in fluid communication between the sterile air source 88 and the sterile zone 64 for directing the sterile air into the sterile zone. The apparatus 58 includes one or more vacuum pumps or other vacuum sources (not shown) mounted within a base support 87 of the apparatus and of a type known to those of ordinary skill in the pertinent art. The vacuum source(s) are coupled in fluid communication with an exhaust manifold at the inlet transfer station 66 and an exhaust manifold at the exit transfer station 86 for drawing the air and fluid sterilant out of the sterile zone 64 and exhausting same through a catalytic converter 92 and exhaust conduit 94. The catalytic converter 92 is of a type known to those of ordinary skill in the pertinent art to break down the exhausted hydrogen peroxide into water and oxygen. In the illustrated embodiment, the exhaust manifolds are mounted at the base of the inlet and outlet stations and extend into the base support 87. As can be seen, the exhaust manifolds at the inlet and outlet stations 66 and 86, respectively, draw into the exhaust passageways located within the base support 87 (not shown) both sterile air and fluid sterilant from the sterile zone 64, and non-sterile ambient air located either within the inlet station or outlet station. As a result, any ambient non-sterile air (including any other ambient gases or contaminants) in the inlet and outlet stations are drawn into the exhaust manifolds, and thereby prevented from entering the sterile zone 64 to maintain the sterility of the sterile zone. Similarly, any sterile air or sterilant is substantially prevented from being re-circulated within the sterile zone, and instead, is drawn into the exhaust manifolds after passage over the containers and/or conveyor portion located within the sterile zone. If desired, one or more exhaust manifolds may be located at the base of the sterile zone (i.e., beneath the conveyor 60 or between the overlying and underlying portions of the conveyor 60) for fully exhausting the air and fluid sterilant and otherwise for avoiding the creation of any "dead" zones where air and/or fluid sterilant may undesirably collect. In one embodiment of the present invention, the flow of sterile air within the sterile zone 64 is controlled to cause the air to flow generally in the direction from right to left in FIG. 4A (i.e., in the direction from the needle filling station 78 toward the sterilizing station 68) to thereby prevent any fluid sterilant from flowing into the needle filling and laser resealing stations 78, 82 and 84. This flow pattern may be effected by creating a higher vacuum at the inlet station 66 in comparison to the outlet station 86. However, as may be recognized by those of ordinary skill in the pertinent art based on the teachings herein, this flow pattern or other desired flow patterns may be created within the sterile zone in any of numerous different ways that are currently known, or that later become known.

In the illustrated embodiment, the conveyor 60 includes a plurality of flights or like holding mechanisms 96 that clamp each container 26 at or below its neck finish (i.e., at the peripheral region immediately below the mouth or opening of the container body 18) or other desired container region. The flights 96 are pivotally mounted on a belt 98 defining a closed loop and rotatably mounted on rollers 100 located on opposite sides of the apparatus relative to each other. One or more drive motors and controls (not shown) may be mounted within the base support 87 and are coupled to one or both rollers 100 for rotatably driving the conveyor 60 and, in turn, controlling movement of the containers 10 through the apparatus in a manner known to those of ordinary skill in the pertinent art. Each flight 96 of the conveyor 60 includes a plurality of container-engaging recesses 102 laterally spaced relative to each other and configured for engaging the respective necks or other desired portions of the containers 26 to support the containers on the conveyor. Although the container-engaging recesses 102 are illustrated as being semi-circular in order to engage the containers 26, they equally may be formed in any of numerous different shapes that are currently known, or that later become known, in order to accommodate any desired container shape, or otherwise as desired. The flights 96 further define a plurality of vent apertures 104 that are laterally spaced relative to each other, and are formed between and adjacent to the container-engaging recesses 102. The vent apertures 104 are provided to allow the sterile air and fluid sterilant to flow over the portions of the containers 26 located above the flights 96 of the conveyor and, in turn, through the conveyor prior to being exhausted through the exhaust manifolds. In the illustrated embodiment, the vent apertures 104 are provided in the form of elongated slots; however, as may be recognized by those of ordinary skill in the pertinent art based on the teachings herein, the vent apertures may take any of numerous different configurations that are currently known, or that later become known. Preferably, the flights 96 laterally engage the neck portions of the containers 26, and effectively isolate the sterile portions of the containers above the flights from the portions of the containers located below the flights that may not be sterile, or that may include surface portions that are not sterile.

The conveyor 60 defines an inlet end 106 for receiving the containers 26 to be fed into the apparatus, and an outlet end 108 for removing the filled and laser resealed containers from the apparatus. As can be seen, the adjacent flights 96 located at the inlet and outlet ends 106 and 108, respectively, are pivoted relative to each other upon passage over the rollers 100 to thereby define a loading gap 110 at the inlet end of the conveyor and an unloading gap 112 at the outlet end of the conveyor. Accordingly, at the inlet end, the containers 26 may be fed on their sides into the loading gap 110 and received within the container-engaging recesses 102 of the respective flight 96. Then, as the conveyor 60 is rotated in the clockwise direction in FIGS. 4A and 4B, the opposing flights 96 are pivoted toward each other to thereby engage the containers 26 between the opposing recesses 102 of adjacent flights. Similarly, at the outlet end 108, the formation of the unloading gap 112 between the respective flights 96 allows the containers loaded thereon to be removed from the conveyor. Any of numerous different devices for automatically, semi-automatically, or manually loading and/or unloading the containers onto the conveyor that are currently known, or that later become known, may be employed. In addition, any of numerous different apparatus that are currently known, or that later become known, may be employed to cap the filled containers after exiting the sterile zone. As may be recognized by those of ordinary skill in the pertinent art based on the teachings herein, the conveyor, the devices for holding the containers onto the conveyor, and/or the apparatus for driving and/or controlling the conveyor may take any of numerous different configurations that are currently known, or that later become known.

In the illustrated embodiment, each flight 96 of the conveyor is configured to hold four containers 26 spaced laterally relative to each other. Accordingly, in the illustrated embodiment, each sterilizing head 70 located within the sterilizing station 70 includes two sterilant manifolds 114, and four sterilizing nozzles 116 mounted on each sterilant manifold. Each sterilizing nozzle 116 is located over a respective container position on the conveyor to direct fluid sterilant onto the respective container. Similarly, each sterilant flushing head 76 located within the sterilant removing stations 72 and 74 includes two flushing manifolds 118, and each flushing manifold 118 includes four flushing nozzles 120. Each flushing nozzle 120 is located over a respective container position on the conveyor to direct heated sterile air or other gas onto the respective container to re-vaporize if necessary and flush away the fluid sterilant. In the illustrated embodiment, the conveyor 60 is indexed by two rows of containers (or flights) at a time, such that at any one time, two rows of containers are each being sterilized, needle filled, and laser resealed within the respective stations, and four rows of containers are being flushed within the two sterilant removing stations (i.e., the first sterilant removing station 72 applies a first flush, and the second sterilant removing station 74 applies a second flush to the same containers). When each such cycle is completed, the conveyor is indexed forward (or clockwise in FIGS. 4A and 4B) a distance corresponding to two rows of containers, and the cycle is repeated. As may be recognized by those of ordinary skill in the pertinent art based on the teachings herein, the apparatus may define any desired number of stations, any desired number of container positions within each station, and if desired, any desired number of apparatus may be employed to achieve the desired throughput of containers.

The needle filling station 78 comprises a needle manifold 122 including a plurality of needles 124 spaced relative to each other and movable relative to the flights 96 on the conveyor 60 for penetrating the stoppers 22 of a plurality of containers 26 mounted on the portion of the conveyor within the filling station, filling the containers through the needles, and withdrawing the needles from the filled containers. Each of the laser resealing stations 82 and 84 comprises a plurality of laser optic assemblies 126, and each laser optic assembly is located over a respective container position of the conveyor flights located within the respective laser resealing station. Each laser optic assembly is connectable to a source of laser radiation (not shown), and is focused substantially on a penetration spot on the stopper 22 of the respective container 26 for applying laser radiation thereto and resealing the respective needle aperture. Also in the illustrated embodiment, each laser resealing station 82 and 84 further comprises a plurality of optical sensors (not shown). Each optical sensor is mounted adjacent to a respective laser optic assembly 126 and is focused substantially on the laser resealed region of a stopper 22 of the respective laser optic assembly, and generates signals indicative of the temperature of the laser resealed region to thereby test the integrity of the thermal seal.

In one embodiment, a non-coring filling needle 124 defines dual channels (i.e., a double lumen needle), wherein one channel introduces the substance into the storage chamber 14 and the other channel withdraws the displaced air and/or other gas(es) from the storage chamber. In another embodiment, a first non-coring needle introduces the substance into the chamber and a second non-coring needle (preferably mounted on the same needle manifold for simultaneously piercing the stopper) is laterally spaced relative to the first needle and withdraws the displaced air and/or other gas(es) from the chamber. In another embodiment, grooves are formed in the outer surface of the needle to vent the displaced gas from the storage chamber. In one such embodiment, a cylindrical sleeve surrounds the grooves to prevent the septum material from filling or blocking the grooves (partially or otherwise) and to thereby prevent air and/or other gases within the container from venting therethrough. In each case, the channels or passageways may be coupled to a double head (or channel) peristaltic pump such that one passageway injects the product into the storage chamber, while the other passageway simultaneously withdraws the displaced air and/or other gases from the storage chamber. In some embodiments, there is preferably a substantially zero pressure gradient between the interior of the filled storage chamber of the containers 26 and the ambient atmosphere.

The containers, stoppers, and needle filling and laser resealing station disclosed herein may each be the same as or similar to, or may include features the same as or similar to any of the various features disclosed in, commonly assigned U.S. patent application Ser. No. 11/339,966, filed Jan. 25, 2006, entitled "Container Closure With Overlying Needle Penetrable And Thermally Resealable Portion And Underlying Portion Compatible With Fat Containing Liquid Product, And Related Method", which is hereby expressly incorporated by reference in its entirety as part of the present disclosure.

In addition, the sterile, empty containers may be constructed in whole or in part, and/or needle filled and thermally resealed, in accordance with the various teachings of any of the following patent applications and patents that are hereby incorporated by reference in their entireties as part of the present disclosure: U.S. patent application Ser. No. 10/766,172 filed Jan. 28, 2004, entitled "Medicament Vial Having A Heat-Sealable Cap, And Apparatus and Method For Filling The Vial", which is a continuation-in-part of similarly titled U.S. patent application Ser. No. 10/694,364, filed Oct. 27, 2003, which is a continuation of similarly titled co-pending U.S. patent application Ser. No. 10/393,966, filed Mar. 21, 2003, which is a divisional of similarly titled U.S. patent application Ser. No. 09/781,846, filed Feb. 12, 2001, now U.S. Pat. No. 6,604,561, issued Aug. 12, 2003, which, in turn, claims the benefit of similarly titled U.S. Provisional Application Ser. No. 60/182,139, filed Feb. 11, 2000; similarly titled U.S. Provisional Patent Application No. 60/443,526, filed Jan. 28, 2003; similarly titled U.S. Provisional Patent Application No. 60/484,204, filed Jun. 30, 2003; U.S. patent application Ser. No. 10/655,455, filed Sep. 3, 2003, entitled "Sealed Containers And Methods Of Making And Filling Same"; U.S. patent application Ser. No. 10/983,178 filed Nov. 5, 2004, entitled "Adjustable Needle Filling and Laser Sealing Apparatus and Method; U.S. patent application Ser. No. 11/070,440 filed Mar. 2, 2005, entitled "Apparatus and Method for Needle Filling and Laser Resealing"; U.S. patent application Ser. No. 11/074,513 filed Mar. 7, 2005, entitled "Apparatus for Molding and Assembling Containers with Stoppers and Filling Same; and U.S. patent application Ser. No. 11/074,454 filed Mar. 7, 2005, entitled "Method for Molding and Assembling Containers with Stoppers and Filling Same".

In the operation of the apparatus and method of the present invention, the container bodies 18 and stoppers 22 are formed by locating the first and second mold portions 12 and 14 in the closed position (FIG. 1A), and introducing molten plastic into the mold cavity spaces formed between the core pins 17 and respective mold cavities 16 and 20. The container parts (i.e., the container bodies 18 and stoppers 22) are sterile at the time of formation due to the heat of the molten plastic used to form the parts. In addition, the introduction of the molten plastic into the mold cavity spaces thermally sterilizes the surfaces that contact the plastic, or at least maintains such surfaces sterile, and thus the surfaces of the container parts are maintained sterile within the mold at the time of formation. Then, as shown in FIGS. 1B-1F, the first and second mold portions 12 and 14 are moved into the open position to allow de-molding of the sterile container parts. In the open position, the first and second sterile surfaces of the mold (40, 42, 44, 46) are maintained sterile. As described above, in the illustrated embodiment of the invention, the first and second sterile surfaces are maintained sterile by heating these surfaces to a temperature sufficient to kill any germs or other contaminants that might collect thereon. The first and second sterile surfaces (40, 42, 44, 46) can be maintained at a predetermined temperature sufficient to maintain surface sterility throughout the period of operation of the apparatus, or if desired, the first and second sterile surfaces may be heated to the requisite temperature for sterility at the time of forming the container parts, or at or immediately prior to opening the mold. Alternatively, as indicated above, the first and second sterile surfaces (40, 42, 44, 46) may be sterilized other than by the use of heat, such as by applying thereto a fluid sterilant, such as vaporized hydrogen peroxide, or by applying radiation thereto, such as UV.

Preferably throughout the molding and assembly operation the laminar flow source 33 directs the substantially laminar flow of sterile gas into the aseptic enclosure 32. Accordingly, in the open position of the first and second mold portions 12 and 14, respectively, the space between the mold portions is maintained sterile upon opening the mold by the flow of sterile gas therethrough. The flexible barriers 54, 55 and 56 further prevent any germs or other contaminants from entering the aseptic enclosure 32 that otherwise might enter such space from the molding machine or assembly device. Because the opposing surfaces of the molds are sterilized (i.e., the surfaces that are contiguous to, extend outwardly from, and otherwise surround the mold cavities), the surfaces of the container parts and mold cavities are thermally sterilized at the time of formation by the heat of the molten plastic, and the laminar gas source maintains an aseptic space between and adjacent to the mold portions, the sterile container parts are sterile at the time of de-molding and are maintained sterile within the aseptic enclosure 32.

Figure 3G:
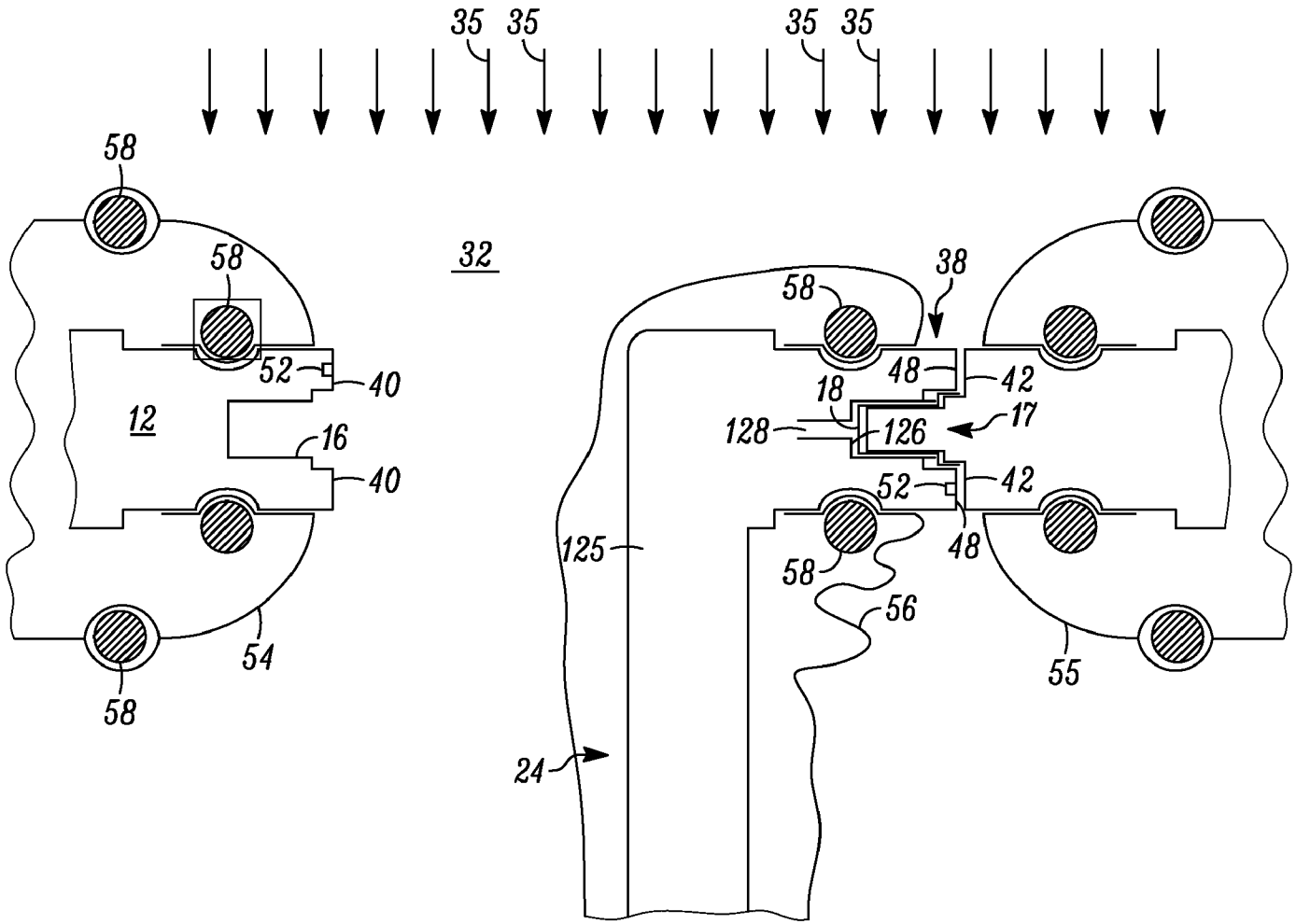

As shown in FIGS. 3A-3G, in order to de-mold the container parts, upon opening the mold into the fully-open position, the end-of-arm tooling 38 of the assembly device 24 is moved into a de-molding position between the first and second mold portions 12 and 14, respectively, and is aligned with the container parts to engage and de-mold the parts. The assembly arm(s) 125 of the assembly device 25 may be a robotic arm, as described above, or may be another type of automated or semi-automated assembly arm configured to perform the function of the assembly arm as described herein. The end-of-arm tooling 38 includes a plurality of container part cavities 126 for receiving therein and engaging the container parts and removing them from the mold. The illustrated container part cavities 126 include vacuum ports 128 that are each coupled to a vacuum source (not shown) for releasably securing the container parts within the cavities in order to de-mold the container parts, retain the container parts on the end-of-arm tooling during manipulation and assembly thereof, and to release the container parts during or following assembly by terminating the vacuum within the respective vacuum ports. As shown in FIG. 3G, once the container parts are engaged by vacuum or otherwise releasably secured within the respective container part cavities 126 in the end-of-arm tooling 38, the respective assembly arm 125 is moved out of the space between the molds to assemble the parts into sterile, sealed, empty containers. If desired, the mold may include a stripper plate (not shown) that is movably mounted on, and movable outwardly relative to a respective one of the mold portions to facilitate de-molding the container parts from the core pins. As described above, in the illustrated embodiment, the third sterile surface 48 of the end-of-arm tooling 38 is maintained sterile by heating the surface to a temperature sufficient to kill any germs or other contaminants that might collect thereon. The third sterile surface 48 can be maintained at a predetermined temperature sufficient to maintain surface sterility throughout the period of operation of the apparatus, or if desired, the third sterile surface may be heated to the predetermined temperature sufficient to maintain sterility only during the period(s) of engaging the container parts. Alternatively, as indicated above, the third sterile surface 48 may be sterilized other than by the use of heat, such as by applying thereto a fluid sterilant, such as vaporized hydrogen peroxide, or by applying radiation thereto, such as UV radiation. As indicated above, the end-of-arm tooling 38 is located within the aseptic enclosure 32, and therefore prior to and during de-molding and assembly of the container parts, the exposed surfaces of the end-of-arm tooling 38 are maintained sterile by the flow of sterile gas within the aseptic chamber. The flexible barrier 56 further prevents any germs or other contaminants from entering the aseptic enclosure 32 that otherwise might enter such space from the assembly device 25. Because the exposed surface of the end-of-arm tooling 38 adjacent to the container part cavities 126 is sterilized (i.e., the surfaces that are contiguous to, extend outwardly from, and otherwise surround the container part cavities 126), the container parts are maintained sterile during de-molding and assembly into containers.

If desired, the apparatus 10 may include dual automated assembly devices 25 wherein each automated assembly device is associated with a respective molding machine or mold. Alternatively, the apparatus 10 may include one assembly device for plural molds, or plural molds and assembly devices. In addition, if desired, the stoppers and container bodies may be molded in different cavities in the same molds. As may be recognized by those of ordinary skill in the pertinent art based on the teachings herein, the apparatus and method of the invention may include any of numerous different configurations of molding machines, molds and assembly devices. In an alternative embodiment, the apparatus includes a molding machine and associated mold for molding the container bodies, and another molding machine and associated mold for molding the stoppers. In this embodiment, each molding machine may be paired with a respective automated assembly device, and each assembly device includes a respective assembly arm and associated end-of-arm tooling. In this alternative embodiment, the container bodies 18 and stoppers 22 can be molded side by side, and de-molded and assembled by the dual automated assembly devices within the aseptic enclosure 32 to thereby form sealed, sterile, empty containers 26. In this embodiment, the apparatus may include opposing clamps (not shown) that engage the end-of-arm tools, and move the end-of-arm tools toward each other to, in turn, insert the stoppers 22 into the corresponding openings of the container bodies 18. Once the stoppers 22 are received within the container bodies 18, the clamps are withdrawn, and the sterile, sealed, empty containers 26 are released by the end-of-arm tooling into the transfer station 34 (FIG. 1) for subsequent needle filling and laser resealing in the needle filling and thermal resealing station 36 (FIGS. 1 and 4A and 4B).

One advantage of the currently preferred embodiments of the present invention is that the sterile or aseptic surfaces formed adjacent to the mold cavities, and/or on the assembly device, in combination with the flow of sterile air through the chamber and over the surfaces and container bodies and stoppers during de-molding and assembly thereof, prevents any contaminants from depositing within the sealed, empty sterile containers and thus significantly facilitates the formation of such sealed, empty sterile containers. In addition, the flexible barriers further prevent the transmission of particles or other unwanted contaminants into the aseptic molding and assembly station, and thus further facilitate the formation of sealed, empty sterile containers.

As may be recognized by those skilled in the pertinent art based on the teachings herein, numerous changes and modifications may be made to the above-described and other embodiments of the present invention without departing from its scope as defined in the appended claims. For example, one or more first mold cavities may be located within a first molding machine, one or more second mold cavities may be located within a second molding machine, and if desired, one or both of the first and second molding machines may include a transfer conduit connected between the outlet of the respective mold cavity and an aseptic enclosure for transferring at least one of the molded container body and stopper into the aseptic enclosure and assembling the stopper and container body therein. In addition, the assembly device may be operatively coupled between one or both of the first mold cavity and the second mold cavity and a transfer station or a needle filling and laser resealing station (or like filling station) for transferring assembled stoppers and containers thereto. Still further, the apparatus and method of the present invention may be employed to mold and fill any of numerous different types of containers that may include any of the numerous different configurations of container bodies, stoppers and/or other container closures. Further, any of numerous different sterilants, or methods or apparatus for sterilizing, may be used to render sterile, and maintain sterile, the surfaces formed adjacent to and extending about the peripheries of the mold cavities, and/or the applicable surfaces of the assembly device that engage the container components. In addition, the assembled containers can be filled with any of numerous different products, including pharmaceuticals, such as injectables, ophthalmic, and dermatological products, vaccines, liquid nutrition products and food and beverage products. Accordingly, this detailed description of the preferred embodiments is to be taken in an illustrative, as opposed to a limiting sense.

What is claimed is:

1. A method comprising the following steps:

(a) providing at least one barrier enclosure defining at least one aseptic chamber; at least one mold including within at least one aseptic chamber at least one first mold cavity shaped to form at least one of a device body and a device closure; and at least one tool including a tool engaging portion located within at least one aseptic chamber and movable relative to the at least one mold;

(b) molding in the at least one first mold cavity at least one of a device body and device closure;

(c) opening the mold to de-mold the at least one of a molded device body and device closure;

(d) maintaining at least one first surface of the mold extending about the first mold cavity substantially sterile at least during opening of the mold to prevent any contaminants from contacting the at least one of a molded device body and device closure during de-molding thereof;

(e) directing a flow of sterile air into the at least one aseptic chamber, including into a space formed between opposing surfaces of the mold during opening thereof, and across the at least one first surface of the mold and any exposed surface of the at least one of a device body and device closure;

(f) moving the tool engaging portion of the tool into the space formed between opposing surfaces of the mold, engaging with the tool engaging portion the at least one of a molded device body and device closure and de-molding same with the tool engaging portion, and directing a flow of sterile air over at least the tool engaging portion and at least one of a molded device body and device closure during de-molding thereof;

(g) providing at least one first flexible barrier coupled to the mold between the at least one first sterile surface and a molding machine and substantially preventing the passage of contaminants from the molding machine therethrough;

(h) providing at least one second flexible barrier coupled to the tool between the at least one engaging portion and a base portion of the tool and substantially preventing the passage of contaminants from the base portion of the tool therethrough; and (i) assembling at least one of a sterile device body and device closure to the other into a sealed, empty sterile device.

2. A method as defined in claim 1, further comprising penetrating a penetrable and resealable portion of the closure and introducing a substance therethrough and into the interior chamber of the device, and thermally resealing the penetrable and resealable portion of the closure.

3. A method as defined in claim 1, further comprising maintaining the at least one first surface of the mold extending about the first mold cavity substantially sterile by heating said at least one surface to a temperature sufficient to destroy any germs thereon.

4. A method as defined in claim 1, further comprising the step of assembling with the tool within at least one aseptic chamber the substantially sterile device closure and device body into a sealed, empty sterile device, and transferring with the tool the device to at least one of a transfer station and a filling and resealing station.

5. An apparatus comprising:

at least one barrier enclosure defining at least one aseptic chamber;

at least one mold including within at least one aseptic chamber at least one first mold cavity shaped to form at least one of a device closure and device body, and at least one first substantially sterile surface extending about the at least one first mold cavity;

at least one tool located within at least one aseptic chamber and including an engaging portion engageable with at least one of a device body and device closure located within the at least one first mold cavity, wherein at least one of the first mold cavity and tool is movable relative to the other for engaging and de-molding at least one of a substantially sterile device closure and device body from the at least one first mold cavity;

at least one source of sterile air in fluid communication with the at least one aseptic chamber and directing a flow of sterile air into the aseptic chamber and over the first sterile surface for maintaining the sterility of said surface and the device closure and device body during de-molding thereof;

at least one first flexible barrier coupled to the mold between the at least one first sterile surface and a molding machine and substantially preventing the passage of contaminants from the molding machine therethrough; and at least one second flexible barrier coupled to the tool between the at least one engaging portion and a base portion of the tool and substantially preventing the passage of contaminants from the base portion of the tool therethrough.

6. An Apparatus as defined in claim 5, further comprising a filling and resealing station configured to receive a sealed, empty sterile device, and including (i) at least one injection member that is movable between a first position for penetrating a penetrable and resealable portion of the closure and introducing a substance from the injection member therethrough and into the interior chamber of the device body, and a second position spaced away from the penetrable and resealable portion of the closure; and (ii) a thermal source for thermally sealing an injection member penetrated region of the penetrable and resealable portion of the closure upon withdrawal of the injection member therefrom.

7. Apparatus as defined in claim 6, further comprising at least one assembly device including the at least one tool, wherein the at least one assembly device and tool are configured to (i) de-mold a substantially sterile device closure from at least one first mold cavity, (ii) de-mold a substantially sterile device body from at least one first mold cavity, (iii) assemble within at least one aseptic chamber the substantially sterile device closure and device body into a sterile, sealed empty device, and (iv) transfer the sterile, sealed empty device to at least one of a transfer station and the filling and resealing station for aseptically filling with a substance and thermally resealing the filled device.

8. An apparatus as defined in claim 5, wherein the at least one mold includes within at least one aseptic chamber at least one first mold cavity shaped to form the device body, at least one second mold cavity shaped to form the device closure, at least one first substantially sterile surface extending about the first mold cavity, at least one second substantially sterile surface extending about the at least one second mold cavity, and two first flexible barriers, wherein one of the first flexible barriers is coupled to the mold between the at least one first sterile surface and a molding machine and substantially prevents the passage of contaminants from the molding machine therethrough, and the other first flexible barrier is coupled to the mold between the at least one second sterile surface and a molding machine and substantially prevents the passage of contaminants from the molding machine therethrough.

9. An apparatus as defined in claim 8, wherein the mold includes a first mold portion and a second mold portion, the first mold portion defines the first sterile surface, the second mold portion defines the second sterile surface, and at least one of the first mold portion is movable relative to the second mold portion between a closed position for molding at least one of the device body and device closure, and an open position with the first and second sterile surfaces spaced relative to each other and defining a portion of the aseptic chamber therebetween.

10. An apparatus as defined in claim 8, wherein the first sterile surface extends about a periphery of the first mold cavity, and the second sterile surface extends about a periphery of the second mold cavity.

11. An apparatus as defined in claim 10, further comprising at least one third substantially sterile surface extending about a periphery of the engaging portion of the tool.

12. An apparatus as defined in claim 5, wherein the at least one first substantially sterile surface is defined by a heated surface.

13. An apparatus as defined in claim 12, wherein the heated surface is defined by a ceramic surface.

14. An apparatus as defined in claim 12, further comprising at least one heating source thermally coupled to the heated surface.

15. An apparatus as defined in claim 14, further comprising at least one temperature sensor operatively coupled to the at least one heating source and adapted to sense the temperature of the heated surface, and wherein the at least one heating source is responsive to the at least temperature sensor to control the temperature of the heated surface.

16. An apparatus as defined in claim 5, wherein the tool includes at least one vacuum port in fluid communication with the engaging portion for drawing a vacuum through the port and, in turn, releasably securing at least one of a substantially sterile device closure and device body thereto.

17. An apparatus comprising:

first means for forming at least one enclosed aseptic chamber;

second means located within at least one aseptic chamber and defining at least one mold cavity for forming at least one of a device closure and device body;

third means for forming at least one first substantially sterile surface region extending about the at least one first mold cavity;

fourth means located within at least one aseptic chamber and movable relative to the third means for engaging and de-molding at least one of a substantially sterile device closure and device body from the at least one first mold cavity;

fifth means coupled in fluid communication with the at least one aseptic chamber for directing a flow of sterile air into the aseptic chamber and over the third means and fourth means for maintaining the sterility of the device closure and device body during de-molding thereof;

sixth means for preventing the passage of contaminants from a molding machine therethrough and into the at least one aseptic chamber; and seventh means for preventing the passage of contaminants from a base portion of the fourth means therethrough and into the aseptic chamber.

18. An apparatus as defined in claim 17, further comprising eighth means for receiving a sealed, empty sterile device body and device closure assembly, penetrating a penetrable and resealable portion of the closure and introducing a substance therethrough and into the interior chamber of the device body, and thermally resealing the penetrable and resealable portion of the closure.

19. An apparatus as defined in claim 18, wherein the eighth means is defined by a filling and resealing station.

20. An apparatus as defined in claim 17, wherein: the first means is defined by at least one barrier enclosure; the second means is defined by at least one mold; the third means is defined by at least one sterile surface extending about a periphery of the least one mold cavity; the fourth means is defined by an end-of-arm tool including an engaging portion engageable with at least one of a device body and device closure; the fifth means is defined by at least one source of sterile air in fluid communication with the at least one aseptic chamber; the sixth means is defined by at least one flexible barrier; and the seventh means is defined by at least one flexible barrier.

* * * * *